US010088155B2

(12) United States Patent
Baetz et al.

(10) Patent No.: US 10,088,155 B2
(45) Date of Patent: Oct. 2, 2018

(54) CENTRAL BURNER FOR MULTI-FUEL MULTIPLE LANCE BURNER SYSTEM

(71) Applicant: Loesche GmbH, Duesseldorf (DE)

(72) Inventors: Andre Baetz, Duesseldorf (DE); Guenther Balgar, Duesseldorf (DE); Ramazan Keles, Duesseldorf (DE); Holger Wulfert, Duesseldorf (DE)

(73) Assignee: Loesche GmbH, Duesseldorf (DE)

( * ) Notice: Subject to any disclaimer, the term of this patent is extended or adjusted under 35 U.S.C. 154(b) by 320 days.

(21) Appl. No.: 14/784,787

(22) PCT Filed: Apr. 19, 2013

(86) PCT No.: PCT/EP2013/058196
§ 371 (c)(1),
(2) Date: Oct. 15, 2015

(87) PCT Pub. No.: WO2014/169963
PCT Pub. Date: Oct. 23, 2014

(65) Prior Publication Data

US 2016/0076763 A1 Mar. 17, 2016

(51) Int. Cl.

| | |
|---|---|
| ***F23C 6/04*** | (2006.01) |
| ***F23D 17/00*** | (2006.01) |
| ***F23D 14/22*** | (2006.01) |

(Continued)

(52) U.S. Cl.
CPC ..... *F23D 17/00* (2013.01); *F23C 6/047* (2013.01); *F23D 14/22* (2013.01); *F23D 14/24* (2013.01);

(Continued)

(58) Field of Classification Search
CPC ..... F23D 14/22

(Continued)

(56) References Cited

U.S. PATENT DOCUMENTS 2,918,117 A * 12/1959 Griffin ..... F23C 9/006 431/116
2,935,128 A * 5/1960 Ferguson ..... F23D 14/04 239/417

(Continued)

FOREIGN PATENT DOCUMENTS

CN 1224490 A 7/1999
CN 101772675 A 7/2010

(Continued)

OTHER PUBLICATIONS

International Search Report dated Jan. 21, 2014 related to PCT/EP2013/058196 filed Apr. 19, 2013.

*Primary Examiner* — Avinash Savani
(74) *Attorney, Agent, or Firm* — Dinsmore & Shohl LLP

(57) ABSTRACT

The invention relates to a central burner for multi-fuel multiple lance burner systems having a central lance with an inner pipe and an outer pipe. The inner pipe and the outer pipe form an annular clearance duct. A plurality of outer lances are arranged around the central lance. A funnel-like mixing device is provided in the extension of the annular clearance duct in the region of the end of the inner pipe. This funnel-like mixing device has openings in its wall for combustion media to flow through. The outer lances each have a nozzle which has openings along the lateral circumferential area, said openings being arranged asymmetrically.

10 Claims, 6 Drawing Sheets

(51) Int. Cl.
*F23D 14/24* (2006.01)

(52) U.S. Cl.
CPC ..... *F23C 2201/20* (2013.01); *F23C 2900/06043* (2013.01); *F23C 2900/07021* (2013.01); *F23D 2900/14241* (2013.01)

(58) Field of Classification Search
USPC ..... 431/181, 187
See application file for complete search history.

(56) References Cited

U.S. PATENT DOCUMENTS 3,115,851 A * 12/1963 Ceely ..... F23D 17/00 110/261
3,245,457 A 4/1966 Smith et al.
3,514,245 A * 5/1970 Adcock ..... F23D 14/125 431/348
4,230,445 A * 10/1980 Janssen ..... F23C 7/004 431/116
5,195,884 A 3/1993 Schwartz et al.
6,019,595 A 2/2000 Wulfert et al.
2003/0108834 A1* 6/2003 Pelton ..... F23D 14/22 431/8
2005/0252430 A1* 11/2005 Satchell, Jr. ..... C21C 5/4606 110/347
2008/0206693 A1 8/2008 Lifshits
2010/0112502 A1* 5/2010 Wunning ..... F23D 14/66 431/215

FOREIGN PATENT DOCUMENTS

CN 102721059 A 10/2012
DE 4208951 9/1993
DE 19627203 1/1998
DE 19752335 A1 5/1999
TW 201219721 A 5/2012

* cited by examiner

CENTRAL BURNER FOR MULTI-FUEL MULTIPLE LANCE BURNER SYSTEM

The invention relates to a central burner for multi-fuel multiple lance burner systems Such multi-fuel multiple lance burner systems are mainly used in hot gas generators. These hot gas generators are used for example to heat process gases within coal grinding plants for example in iron ore smelting installations, or are used within coal grinding plants in coal gasification installations. The heated process gases are hereby used both to convey the ground coal dust and also for simultaneous grinding-drying.

In order to start up such a grinding-drying plant it is necessary both to heat the hot gas generator itself, that is to say to warm it up, and also to warm up the whole grinding-drying plant comprising the main components: mill, classifier, filter, mill fan, hot gas generator and corresponding process gas lines. During warming-up of such a plant the main aim is to raise the temperature of the plant components above water dew point in order that condensation of water within the plant cannot arise. On the other hand when grinding coal, low-oxygen conditions must be present in order to prevent explosions. Such inert operating states can be achieved, inter alia, by using low-oxygen flue gases of a hot gas generator. For this start-up process of the grinding circuit, very low powers of the hot gas generator must be present in comparison with the main operation, in order to ensure that no temperature-related damage arises in the plant components. In general a control ratio of 1:8 is required for a hot gas generator for the operation of a grinding circuit and a control ratio of 1:40 if the warming-up of the whole system is also taken into consideration. The control ratio of 1:8 is measured on account of the different moisture levels of the material to be ground and dried, at different outside temperatures and with different throughputs of the mill.

For combustion in hot gas generators, in particular within the scope of a grinding-drying process, gases are preferably used which arise or are produced in downstream processes in which the coal dust is used. For example, in the case of coal gasification, synthesis gas is produced. Since, however, these gases are not yet available in the initial operating states when starting up the system, it is often necessary to design the hot gas generators so that they can be operated with different fuels. In order to start the whole plant, such as when powering up and for the initial operating duration, a different gas is often used such as for example natural gas. As soon as sufficient coal dust has been produced, coal gasification can be commenced. As soon as this downstream process has also started and synthesis gas is produced it is desirable to operate the hot gas generator with the lower-priced synthesis gas. It is accordingly necessary for the burner of the hot gas generator to be able to achieve, with each of the fuels, 100% of the required power for the downstream processing installation.

DE 196 27 203 C2 discloses for example a multiple lance burner. Furthermore the exemplary structure of a hot gas generator with a burner is known from DE 42 08 951 C2.

In order to be able to achieve the required high control range of 1:40 with a hot gas generator, said hot gas generator often has a burner which possesses a separate start burner. This start burner is used to warm up the hot gas generator. It is also used to warm up the downstream plant components, for example within the grinding circuit. The actual burners of the hot gas generator cannot be used for this, as they would often emit too much heat even at the lowest power.

This would mean that careful heating-up of the hot gas generator and the downstream process could not be safely carried out.

However, the additional incorporation of a start burner requires considerable resources. In particular it is to be considered that it is only used for the start process or in standby operation. It is therefore desirable, in case of burners for hot gas generators, to be able to omit a separate start burner and to be able to carry out the heating of the hot gas generator and the upstream process directly with the burners of the hot gas generator. For this, however, the previously described high control range of 1:40 is required.

It is the object of the invention to create a central burner for a multi-fuel multiple lance burner system which can be operated with different burner types and has a high control range so that a separate additional start burner can be omitted.

This object is achieved according to the invention through a central burner having the features of claim 1.

Further advantageous embodiments are indicated in the dependent claims, the description and the figures.

According to claim 1 a central lance is provided in the central burner according to the invention, said central lance having an inner pipe and an outer pipe. These two pipes are orientated coaxially with each other. The inner and the outer pipe are thereby arranged spaced apart from each other in the radial direction to form an annular clearance duct. Combustion media can be conveyed through this annular clearance duct. The outer pipe of the central lance extends from a first feed chamber to a combustion chamber. The outer pipe hereby extends further into the combustion chamber than the inner pipe.

A plurality of outer lances are arranged around the central lance itself, said outer lances extending at least from a second feed chamber likewise to the combustion chamber.

A funnel-like mixing device is arranged in the extension of the annular clearance duct between the inner pipe and the outer pipe in the region of the end of the inner pipe. This mixing device has an opening in the region of the end of the inner pipe, said opening corresponding substantially to the diameter of the inner pipe. In the extension of the annular clearance duct the mixing device has at its other end a further opening which is larger than the diameter of the inner pipe but smaller than the diameter of the outer pipe. Openings for combustion media to flow through are provided in the wall of the mixing device.

A nozzle is arranged on each outer lance, said nozzle having at least lateral openings which are arranged distributed asymmetrically along the lateral circumferential area of the nozzle. It is additionally provided that the outer lances and/or the nozzles of the outer lances are formed to be axially rotatable in relation to the central lance in order to influence the position of the openings of the nozzles.

A basic idea of the invention can be seen in forming a central burner for multi-fuel multiple lance burner systems which itself has a control ratio of 1:40. This means that it is possible with this central burner both to heat a hot gas generator with a multi-fuel multiple lance burner itself which has the central burner according to the invention and also to operate, with the hot gas generator, the downstream plant components completely at full load. It is thus possible to construct a hot gas generator or respectively a burner with the central burner according to the invention without a start burner.

Further lances for a second fuel can then be provided surrounding the central burner. In other words, the central burner is designed to operate with a fuel and the further lances surrounding it to operate with a second fuel.

The high control ratio, according to the invention, of the central burner is achieved, inter alia, by combining a central lance with a plurality of outer lances surrounding it. The design according to the invention of the funnel-form mixing device at the end of the inner pipe within the outer pipe of the central lance also plays an essential role here.

During operation of the central burner the fuel, for example natural gas, is fed through the inner pipe of the central lance and through the outer lances. The annular clearance duct between the inner pipe and the outer pipe is used to feed combustion air. This can be normal ambient air, but also an $O_2$-depleted gas in order to guarantee the required oxygen upper limit for a downstream grinding circuit. By means of the funnel-like mixing device according to the invention which has openings in its wall, a good mixing of the fuel blown in through the inner pipe with the combustion air is achieved so that on the one hand a stable flame is produced but on the other hand also a safe and complete combustion of the fuel is achieved. This inner flame in the region of the central lance also serves to support the flames of the outer lances.

A further core idea of the invention can be seen in the construction of the nozzles of the outer lances. These have at least lateral openings which are asymmetrically distributed along the lateral circumferential areas of the nozzles. In addition the outer lances or respectively the nozzles thereof are rotatable, whereby the position of the nozzles is changed.

This construction allows the central burner to be used in different multi-fuel multiple lance burner systems, in which the further lances for the second fuel surrounding the central burner can vary in design. By means of the position of the nozzles on the outer lances the central burner can thus be adapted to differently designed and/or positioned second fuel lances. In addition, by varying the nozzles of the outer lances the advantage is produced that a multi-fuel multiple lance burner with the central burner according to the invention can be set so that hardly any oscillations, or no oscillations at all, are present within the furnace, thus within the muffle, or respectively also in the combustion chamber. This is important for safe operation of a multi-fuel multiple lance burner system, as these oscillations can lead to unstable system states, in which a safe operation of the burner or respectively the hot gas generator is difficult to maintain.

The oscillations in the combustion chamber depend, inter alia, upon the type of lance used to combust the second fuel and also upon the number and positioning thereof. With the central burner according to the invention, through the configuration of the nozzles of the outer lances, the central burner can be adapted relatively simply to second fuel lance types of different structures, a different number of second fuel lances and different positions of these with great flexibility.

It is hereby provided in operation to feed fuel through the inner pipe and the outer lances to the combustion chamber. Combustion air is preferably fed through the annular clearance duct. Within the scope of the invention the term "combustion air" is used for a fluid which is used as an oxygen carrier for the combustion. This can for example be ambient air, an $O_2$-depleted gas or a mixture for example consisting of ambient air and recirculated low-oxygen gas. An $O_2$-depleted gas is used in particular when the oxygen content of the heated process gas is to be kept as low as possible. In principle, however, other fluids, in particular in gaseous form, can also be used as oxygen carriers.

Combustible gases such as natural gas, synthesis gas or blast furnace gas, for example, can be described as fuel within the scope of the invention.

The outer lances can be arranged as desired in relation to the central lances. It is advantageous, however, if the outer lances are arranged at equal radial distance from the central lance, in particular in a ring. A support of the flames of the outer lances can hereby be achieved through the flame of the central lance so that a high control range is facilitated during operation of the central burner.

A good mixing of the fuel with the combustion air can be achieved if, in addition to the funnel-like mixing device, swirl means are provided. These can be provided for example on the inner wall of the outer pipe and/or on the outer wall of the mixing device. The swirl means can hereby be formed as swirl plates. In addition it is possible to centre the mixing device by means of the swirl means on the inner wall of the outer pipe. This is the case both if the swirl means are fixed to the inner wall of the outer pipe and to the mixing device itself. Within the scope of the invention the swirl means can also be regarded as turbulence-generating structures or swirl plates. The aim of these turbulence-generating structures is to add turbulence pulses to the gases blown in so that the different gases mix together better, in particular the combustion gas and the combustion air.

It is advantageous if the inner pipe ends with a nozzle which has openings both in the axial and in the radial direction. It is, however, also possible to provide the openings only in one of these two directions. A design of the pipe with a nozzle improves the mixing behaviour of the fuel with the combustion air, which in turn brings with it an improved and increased control range.

The ratio of the fuel supply between the inner pipe of the central lance and the outer lances is preferably fixed over the whole working range of the central burner, in particular remaining constant. It can vary in dependence upon the exact number of outer lances and is on average approximately 10%-20%: 90%-80% in relation to the fuel supply from the inner pipe of the central lance to the outer pipes. Such a fixed ratio has proved advantageous for a stable operation of the central burner. In addition a separate control section for the outer lances and the central lance can be omitted and merely one control section can be used for this.

The central burner according to the invention can be provided in a multi-fuel multiple lance burner which can then be formed without a start burner. This means that a separate start burner in addition to the further components of a hot gas generator, in particular the muffle, and/or of a processing plant equipped with the multi-fuel multiple lance burner is not necessary, as the multiple lance burner according to the invention has an adequately high control range of up to 1:40, so that it can carry out the function of the start burner itself. However, the central burner may not hereby be regarded in any circumstances as a start burner itself, since it can also be operated, in contrast with the start burner, in an operating state in which it supplies the whole connected processing plant, for example a grinding circuit, with sufficient energy, for example hot process gases. Furthermore the omission of a start burner brings with it additional advantages so that a complete control section for the start burner is no longer required.

A multi-fuel multiple lance burner with a central burner according to the invention can be used in a hot gas generator as a burner. In addition a hot gas generator has a burner muffle and a feed for process gas to be heated.

As a result of the construction of the central burner according to the invention the use of the central burner with different structures of multi-fuel multiple lance burners is possible. For example, such a multi-fuel multiple lance burner can be formed so that the central burner is arranged within a central burner pipe. In other words, this central burner pipe is connected to the outer lances of the central burner.

Additional swirl means can be provided on the inner wall of the central burner pipe. In the case of such a construction, combustion air is also fed through the large annular clearance duct between the outer pipe of the central lance and the central burner pipe. The swirl means on the inner wall of the central burner pipe ensure good mixing of the combustion air with the fuel which is in particular blown out through the outer lances.

Irrespectively of the exact embodiment of the second fuel lances for the multi-fuel multiple lance burner, these should preferably be arranged around the central burner pipe or the central burner. This can be realised for example in a ring-like manner similarly to the outer lances.

The second fuel lances can be formed for example from two pipes arranged one inside the other. According to this configuration a second fuel can be fed through the inside of the pipes arranged one inside the other and combustion air through the outer pipe. Swirl means can also be provided at the ends of the two pipes. In particular, the annular clearance duct between the outer and the inner pipe of the second fuel lance is suitable to be used for this. The swirl means are preferably formed, like all swirl means described within the scope of the invention, as swirl plates. In principle it is also possible to use a plurality of, for example three, pipes arranged one inside the other as second fuel lances. In addition to the combustion air and the second fuel, a further fluid can be supplied as an additional fuel or for combustion.

It is, however, also possible to form the second fuel lances through a single pipe. This can have an end nozzle. By means of the end nozzle the exit direction of the second fuel can be influenced so that the mixing of the fuel with the combustion air is additionally improved here.

In principle the second fuel lances can be arranged as desired in relation to the central burner. It is possible for example to arrange them at the same radial distance from the central lance, preferably in a ring-like manner. Such a design is preferable in particular in the case of second fuel lances which consist of a single pipe. A homogeneous flame pattern is achieved in this configuration.

Furthermore a burner outer pipe can be provided surrounding the second fuel lances. Said burner outer pipe outwardly terminates the multi-fuel multiple lance burner. In dependence upon the design of the second fuel lances, combustion air can also be fed through the intermediate space between the burner outer pipe, the central burner pipe or the outer pipe of the central lance if a central burner pipe is not provided. This second variant is useful in particular with a design, in which the second fuel lances are formed from an individual pipe with an end nozzle. The burner outer pipe forms the burner mouth at its end facing the combustion chamber. For this purpose it can have a shape which also influences the flame geometry. For example it can be formed in the end region slightly curved towards the central axis of the burner.

According to an embodiment, provision can be made for further swirl means on the inner wall of the burner outer pipe. These serve for better mixing of the combustion air with the fuel and thus facilitate an improved combustion behaviour.

In principle all swirl means described within the scope of the invention can be designed as desired. Preferably, however, they are designed as swirl plates which convey the flow. These swirl plates are provided in particular at an angle to the outflow direction of the gases in order to provide a swirl, that is to say a deflection, of the outflowing gases as they flow out.

According to a preferred embodiment an impeller is provided. This can be provided in dependence upon the formation of the second fuel lances on different regions of the multi-fuel multiple lance burner.

If for example a central burner pipe is provided, the impeller can be located in the region between the inner wall of the central burner pipe and the outer pipe of the central lance. It can extend as far as swirl means provided on the inner wall of the central burner pipe.

If a central burner pipe is not provided, the impeller can be located in a region between the inner wall of the burner outer pipe and the outer pipe of the central lances. Also in this case, the impeller can—if swirl means are provided on the inner wall of the burner outer pipe—extend from these as far as the outer wall of the outer pipe of the central lance.

Independently of the exact position of the impeller, the latter extends according to a preferred embodiment in particular as far as a region in which the outer pipe of the central lance ends. The impeller itself can be designed in the manner of a perforated plate, whereby additionally a turbulence of the combustion air which is conveyed in the annular clearance duct between the outer pipe of the central lance and central burner pipe or burner outer pipe is achieved.

The second fuel lances can extend through the impeller so that they end after the impeller in the direction of the combustion chamber.

According to a preferred embodiment the impeller is designed so that it can be axially displaced. This means that it can be displaced back and forth in the direction of the combustion chamber. With this construction, oscillations arising through the combustion can be minimised or prevented.

The position of the impeller also serves to influence the turbulence of the combustion air and thus to contribute to a desired combustion behaviour.

The invention will be explained in greater detail below by reference to exemplary embodiments and schematic drawings, in which.

Figure 1:
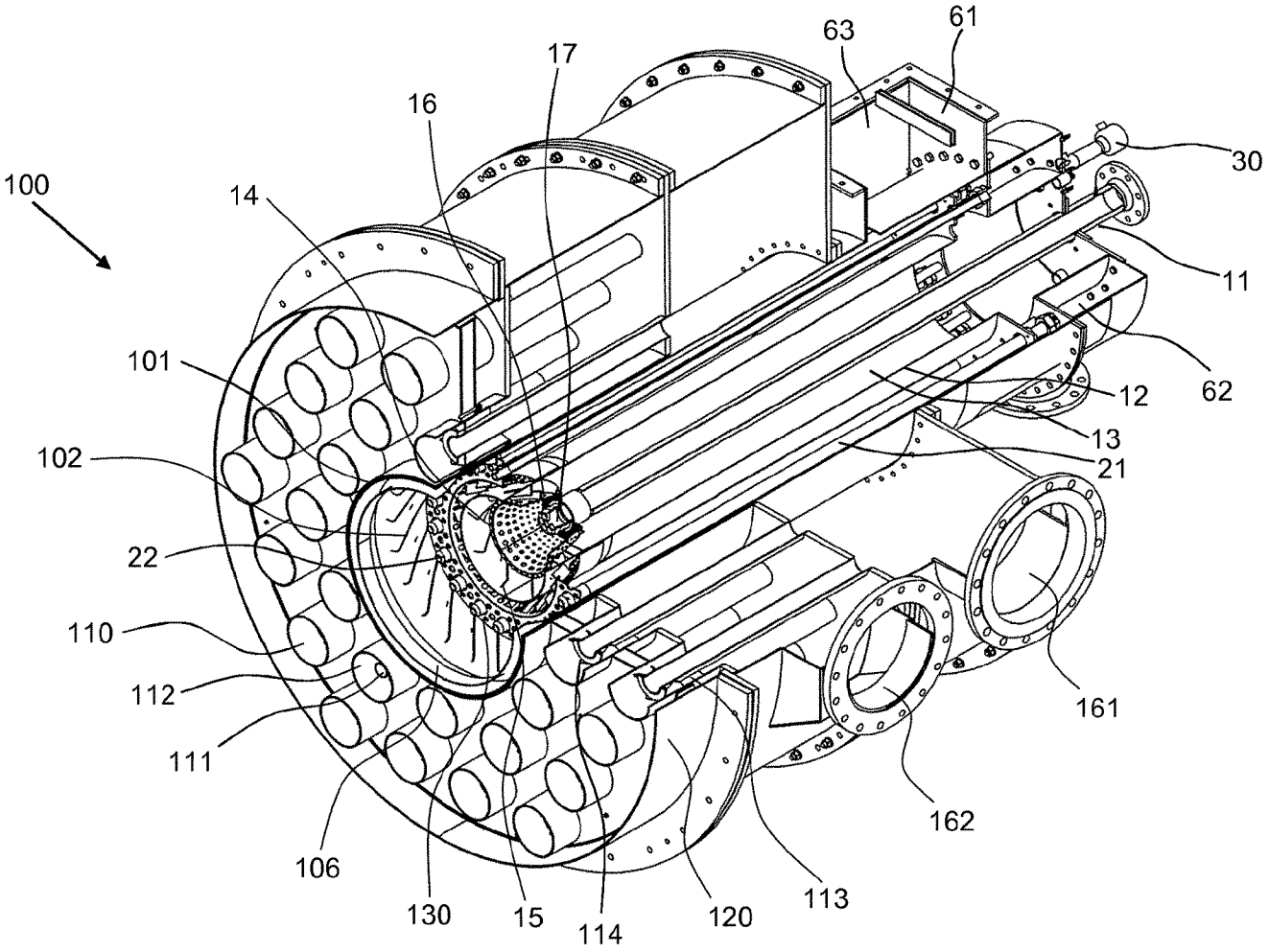
FIG. 1 shows a perspective sectional view of a first multi-fuel multiple lance burner with a central burner according to the invention.
Figure 2:
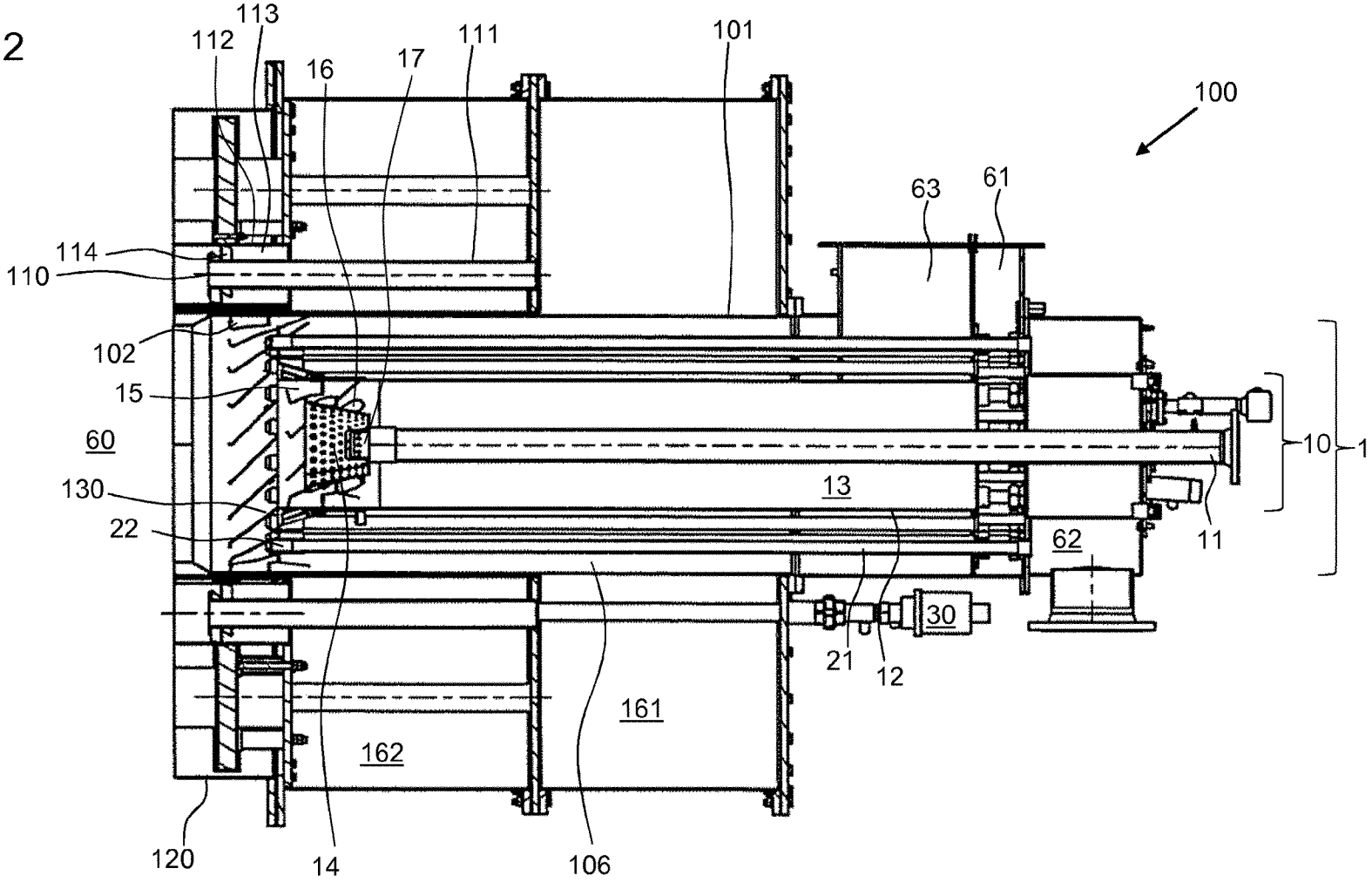
FIG. 2 shows a sectional view of the multi-fuel multiple lance burner according to FIG. 1.

FIGS. 1 and 2 show a first embodiment of a multi-fuel multiple lance burner 100 with a central burner 1 according to the invention once in a perspective view, which is partially cut away, and once in a sectional view.

The central burner 1 is formed from a central lance 10, outer lances 21 surrounding it and a central burner pipe 101 outwardly terminating the central burner 1.

The central lance 10 has an inner pipe 11 and an outer pipe 12. These are arranged coaxially with respect to each other in such a way that an annular clearance duct 13 is formed between the outer side of the inner pipe 11 and the inner side of the outer pipe 12. The outer pipe 12 extends further in the direction of a combustion chamber 60 than the inner pipe 11. At the end of the inner pipe 11 a mixing device 14 is provided. This is formed like a funnel.

The mixing device 14 is provided with its first end in the end region of the inner pipe 11 and has a diameter corresponding substantially to that of the inner pipe 11. In the direction towards the opposite end of the mixing device 14, the latter widens in the manner of a funnel. Recesses, in particular holes, are provided in the wall of the mixing device 14.

Swirl means 15 in the form of swirl plates are arranged on the inner side of the outer pipe 12. Besides their actual function of causing turbulence of combustion air, they also serve for centring the mixing device 14 centrally over the inner pipe 11 of the central lance 10. Swirl means 16, for example again in the form of swirl plates, can also be provided on the outer side of the mixing device 14.

The inner pipe 11 itself ends with a nozzle 17 in the region of the mixing device 14. This nozzle 17 has both axial and also radial openings. These openings preferably have such dimensions that a larger part of the medium flowing through the inner pipe 11 can exit in the axial direction than in the radial direction.

A plurality of outer lances 21 are arranged in a ring around the outer pipe 12 of the central lance 10. They are at an equal distance from each other. The outer lances 21 are also respectively arranged at the same distance from the central axis of the multi-fuel multiple lance burner 100 which extends in the inner pipe 11.

The outer lances 21 respectively end with a nozzle 22. Said nozzle 22 has a plurality of openings 23 which are radially arranged. The openings are hereby provided asymmetrically on the circumferential area of the nozzle 22, as schematically shown in FIG. 5.

Figure 5:
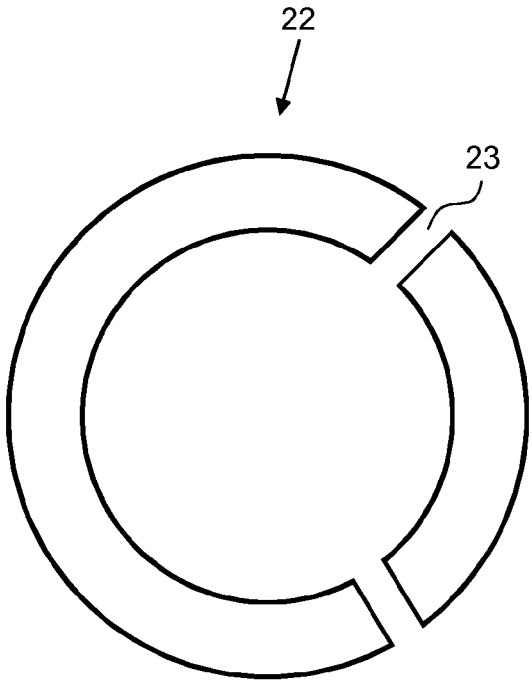
FIG. 5 shows a section through a nozzle of an outer lance.

FIG. 5 shows a section through a nozzle 22 of an outer lance 21 in the region of the openings 23. It is hereby clear that the two openings 23 shown here are provided asymmetrically on the nozzle 22.

The nozzle 22 and/or the outer lances 21 can be designed to be rotatable about their axis. It is hereby possible to orientate the openings 23 of the nozzle 22 as desired in relation to the central mid-axis of the multi-fuel multiple lance burner 100. With this orientation, the central burner 1 can be set to different multi-fuel multiple lance burners, as shown in FIG. 1 and later in FIG. 3. It is also hereby possible to minimise oscillations arising during operation.

The central burner 1 ends in the embodiment according to FIGS. 1 and 2 through a central burner pipe 101. Swirl means 102 in the form of swirl plates are in turn provided on the inner wall of the central burner pipe 101.

The constructive design of the central burner 1 with the central lance 10 and the funnel-shaped mixing device 14 and the impeller 130 bring about a stepwise combustion of the combustion gas and an internal recirculation of the fluid flow. This allows the high control ratio of 1:40, since an extremely stable flame is facilitated by the internal recirculation and the staged combustion.

A plurality of second fuel lances 110 are arranged around the central burner 1. These second fuel lances 110 each have an inner pipe 111 and an outer pipe 112 surrounding the inner pipe 111. The inner pipe 111 and the outer pipe 112 are orientated coaxially relative to each other so that an annular clearance duct 113 is formed between them. Swirl means 114 extending into the annular clearance duct 113 are provided in the end region of the inner pipe 111. The multi-fuel multiple lance burner 100 is outwardly terminated by a burner outer pipe 120.

Furthermore an impeller 130 is provided between the central burner pipe 101 and the outer pipe 112 of the central lance 110. Said impeller 130 is formed similarly to a perforated plate. The outer lances 21 extend through the impeller 130. Furthermore the position of the impeller 130 can be axially changed. By means of this change the central burner 1 can be adapted to different multi-fuel multiple lance burners, as oscillations arising in the combustion chamber 60 can hereby be minimised. This is realised through the axial positioning of the impeller 130. In addition the impeller 130 homogenises the combustion air which is conveyed through an annular clearance duct 106 formed between the outer pipe 12 and the central burner pipe 101.

The connection and operation of the multi-fuel multiple lance burner 100 are explained in detail below.

The inner pipe 11 of the central lance 10 and the outer lances 21 are preferably connected to a feed for a first combustion gas, for example a natural gas supply. The inner pipes 111 of the second fuel lances 110 can be connected to a feed for a second combustion gas, for example synthesis gas. The annular clearance duct 113 and the annular clearance duct 106 which is formed between the outer pipe 12 of the central lance 10 and the central burner pipe 101 is connected to a combustion air supply. In general, an in particular gas-form oxygen carrier can be considered as combustion air within the scope of the invention.

In principle the combustion air supplied here can be an $O_2$-depleted gas in order to fulfil the requirement of the reduced oxygen content in a downstream grinding plant.

In the embodiment shown here, the feed to the inner pipe 11 is realised directly, the feed to the annular clearance duct 13 via a feed chamber 61. The feed to the outer lances 21 is realised via a feed chamber 62. Combustion air is conveyed via a feed chamber 63 into the annular clearance duct 106. The feed of the second combustion gas to the inner pipes 111 of the second fuel lances 110 is realised via a feed chamber 161 and the feed of the combustion air to the annular clearance ducts 113 via a feed chamber 162.

The feed of the first combustion gas to the inner pipe 11 of the central lance 10 and to the outer lances 121 is hereby provided in a fixed ratio, preferably in a range of 15%:85%. Similarly, the feed of the combustion air through the feed chambers 61 and 63 is set to a fixed ratio.

An ignition device 30 is used to start the multi-fuel multiple lance burner 100. Said ignition device 30 is only provided for the actual, very short ignition process. The central burner 1 is ignited with it. Firstly the central burner 1 is operated at a very low stage, wherein fuel flows both through the inner pipe 11 of the central lance 12 and through the outer lances 21. Natural gas can be used for example as fuel. This is realised, as stated, with a very low power in order to heat a hot gas generator in which the burner is provided and to heat the downstream units. In this process the burner muffle of the hot gas generator extending around the combustion chamber 60 is also heated. As soon as the downstream units and the hot gas generator, in which the burner 100 is used, have been sufficiently heated themselves, a switchover into productive operation can take place. This switchover is realised merely through powering up the central burner 1. This means that it is supplied with more fuel and more combustion air.

If the burner 100 is used for example as a hot gas generator for a coal grinding plant which is used for synthesis gas production, it takes some time until sufficient synthesis gas is available through the synthesis gas production to also operate the burner. As soon as this less expensive synthesis gas is available in a sufficient amount, the burner can be switched to synthesis operation. In this case synthesis gas is introduced through the inner pipes 111 of the second fuel lances 110. At the same time combustion air is fed through the annular clearance ducts 113. If a stable burning state is reached via the synthesis gas combustion, the central burner 1 can now be powered down and ideally switched off completely. This saves for example the natural gas necessary for its operation which is of a higher quality and hence more expensive. It is likewise possible to increase the combustion of the synthesis gas and at the same time reduce the combustion of the natural gas.

Figure 3:
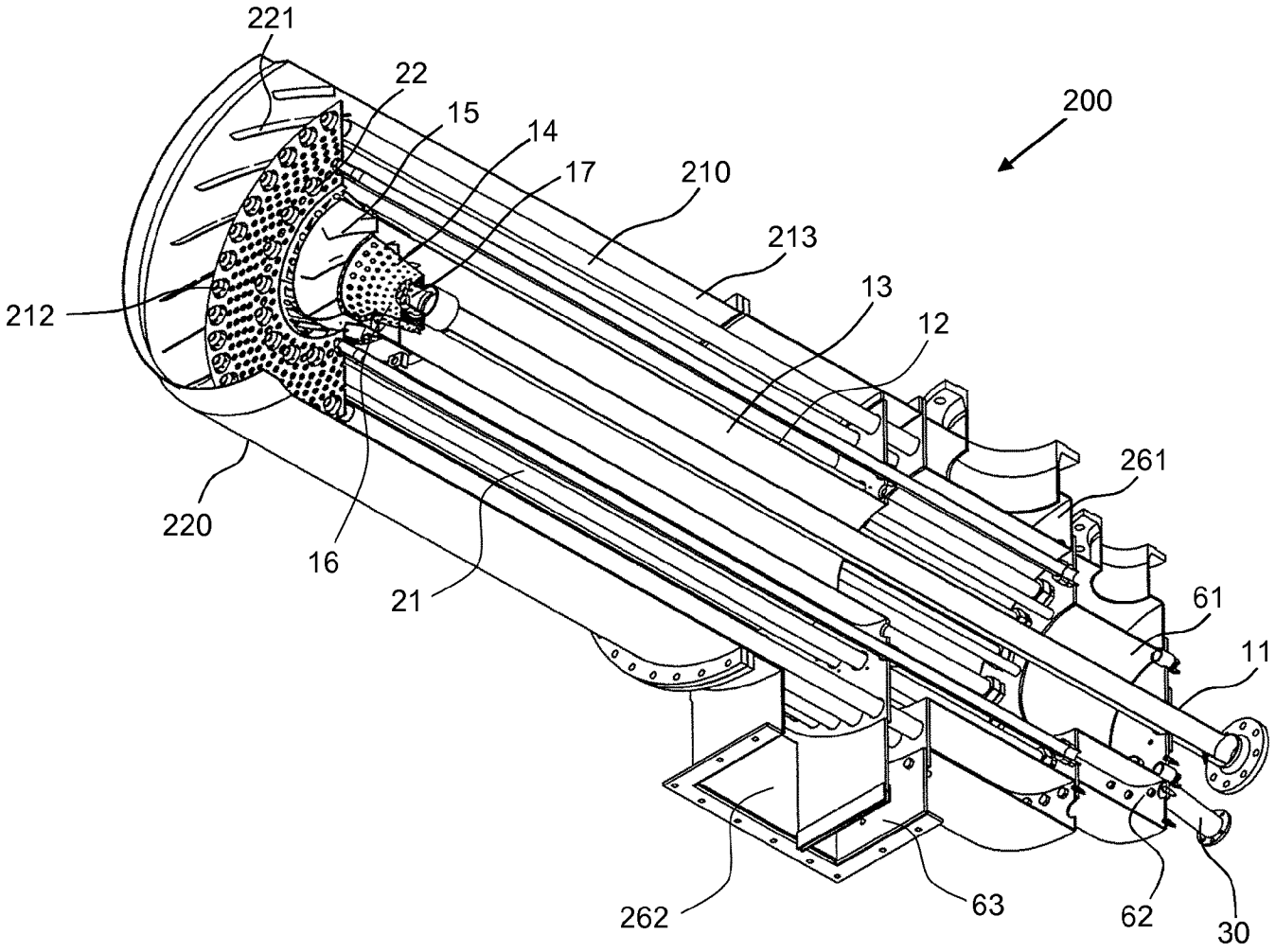
FIG. 3 shows a perspective sectional view of a second multi-fuel multiple lance burner with a central burner according to the invention.
Figure 4:
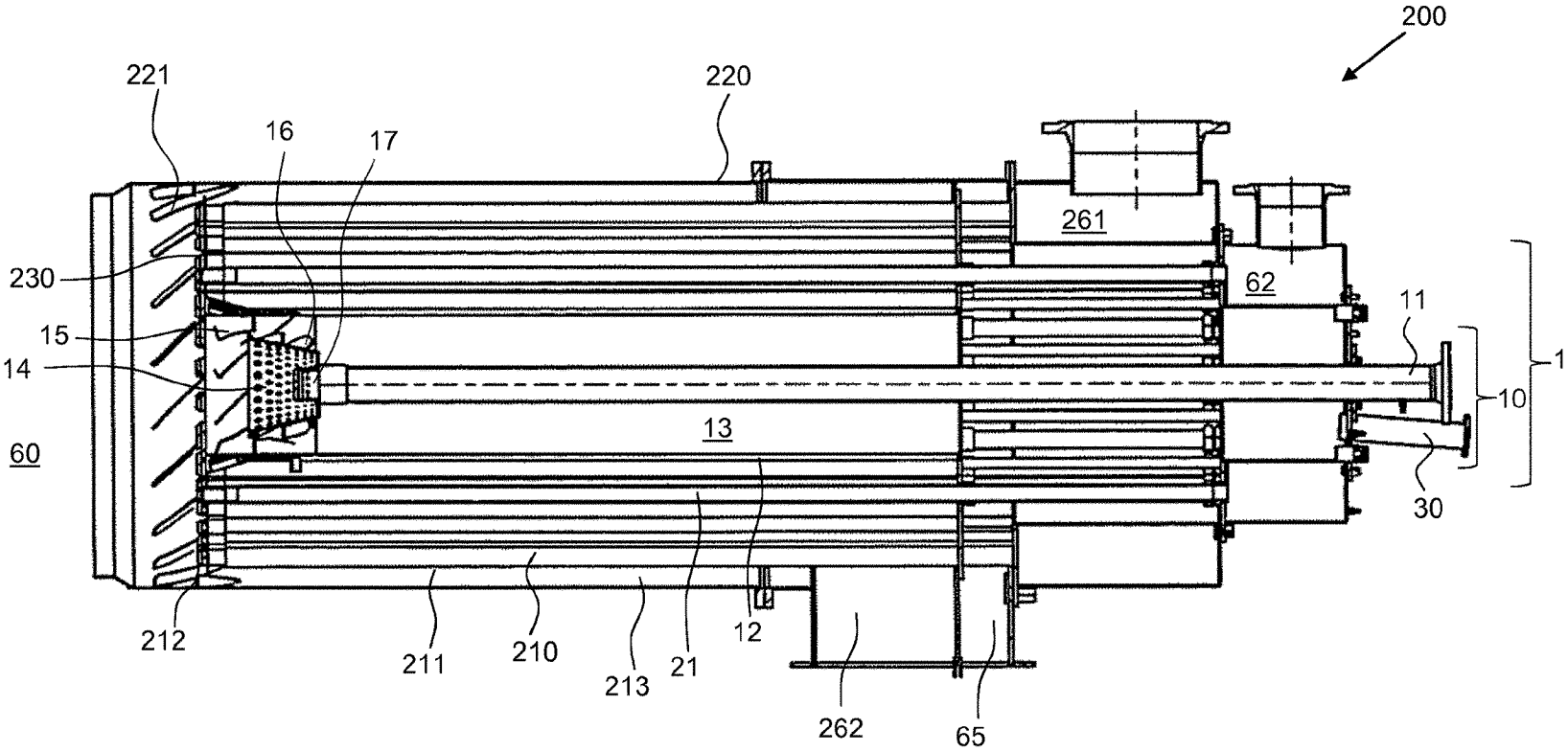
FIG. 4 shows a sectional view of the multi-fuel multiple lance burner according to FIG. 3.

FIGS. 3 and 4 show a different variant of a multi-fuel multiple lance burner 200 with a central burner 1 according to the invention. Details are provided below only concerning different configurations for the embodiment according to FIGS. 1 and 2. The same components are identified by the same reference numerals.

The essential difference between the multi-fuel multiple lance burner 200 and the multi-fuel multiple lance burner 100 is that a different type of second fuel lances 210 is used. These consist of an individual pipe 211 and have an end nozzle 212.

A further difference from the burner 100 is that the burner 200 does not have a central burner pipe 101.

For this, swirl means 221 in the form of guide plates are provided on a burner outer pipe 220. Furthermore an annular clearance duct 213 is formed between the burner outer pipe 220 and the outer pipe 12 of the central lance 11.

According to this embodiment of the burner 20 an impeller 230 is provided in the region between the outer pipe 12 of the central lance 10 and the burner outer pipe 220. Similarly to the case of the burner 100, the outer lances 21 extend, in the same way as the second fuel lances 210, through the impeller 230. This impeller 230 can also be displaced in the axial direction in order to minimise oscillations which may arise in the combustion chamber 60. Similarly to the impeller 130, the impeller 230 also homogenises the combustion air which is conveyed through an annular clearance duct 213 formed between the outer pipe 12 and the burner pipe 220.

The supply of the individual lances and annular clearance ducts with fuel such as natural gas or synthesis gas and also combustion air is explained below.

The supply of the fuel to the inner pipe 11 of the central lance 10 is realised directly. The supply of the combustion air into the annular clearance duct 13 is realised via the feed 65. The supply of the outer lances 21 with fuel is also realised via the feed chamber 62.

By means of a feed chamber 261, the second fuel lances 210 are supplied with the second fuel, for example synthesis gas. Combustion air is fed via the feed chamber 262 into the annular clearance duct 213.

The mode of operation of the burner 200 is similar to that of the burner 100. This means that in order to heat the burner 200 or the hot gas generator equipped with the burner 200, the central burner 1 is firstly started at a low stage. As soon as the burner 200 itself and the hot gas generator equipped therewith are sufficiently warm, the downstream processing installation is further heated with low power. As soon as it is sufficiently heated, productive operation can be commenced. For this, the central burner 1 is powered up and operated with a sufficient power.

As soon as sufficient second fuel, for example synthesis gas, is available, the second fuel lances 210 are supplied with it. If the supply with second fuel is secured and the combustion is in a stable state, the supply with the first fuel can be adjusted and the central burner 1 can be essentially switched off.

The differences between the two burner variants 100 and 200 are explained in detail below and subsequently the respective advantages clarified.

In order to achieve a higher power in the second fuel operation in the case of the burner 100, it is sufficient to provide more second fuel lances. This is realised by each second fuel lance carrying along its own combustion air according to its construction. In other words each second fuel lance has a fixed power. Of course, the total diameter of the burner then also increases.

In contrast with the burner 200, the burner 100 can be operated with a lower pressure. The burner system 200 has a clearly lower weight than the burner 100 due to the differently designed second fuel lances.

Figure 6:
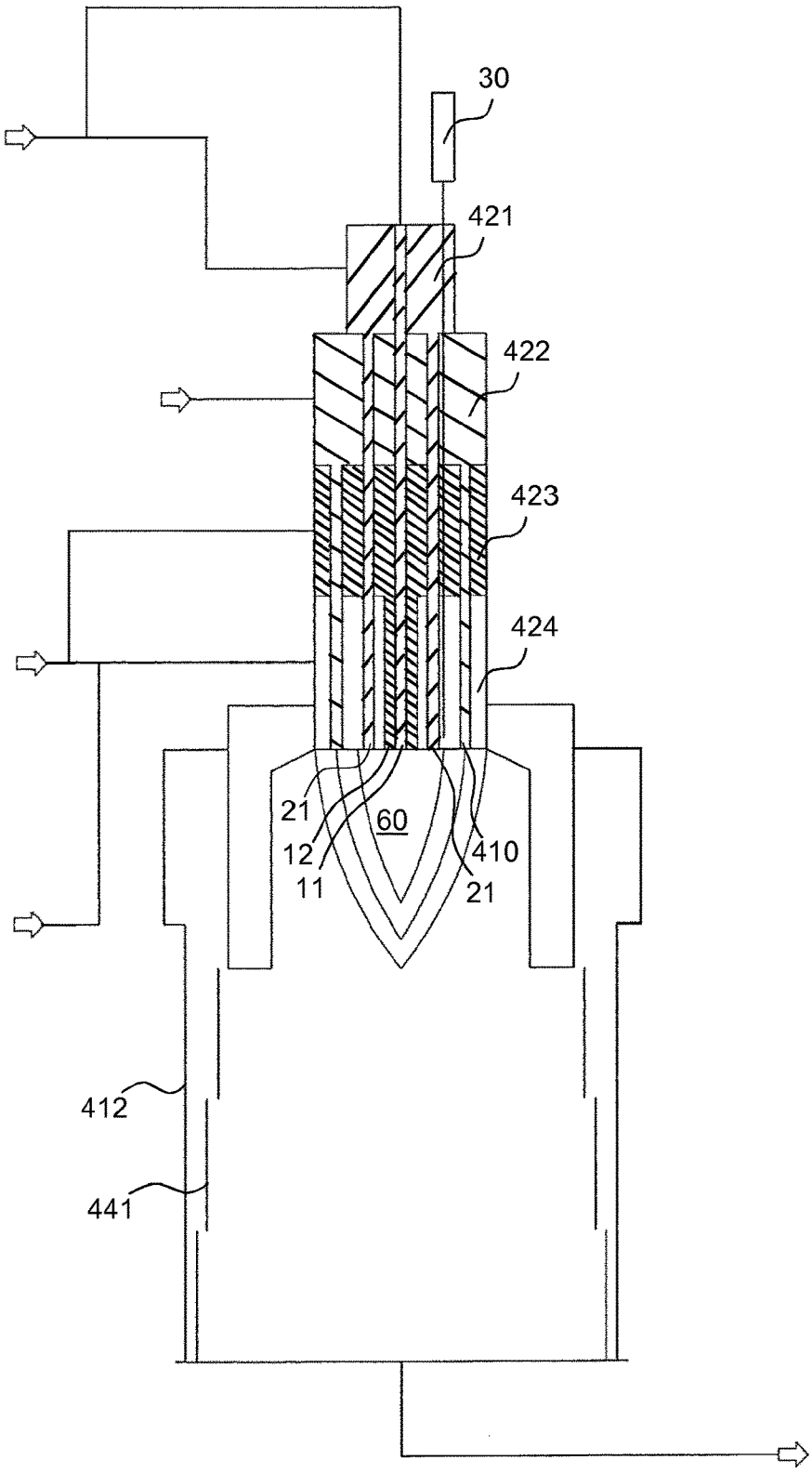
FIG. 6 shows an illustration to demonstrate the operation of a hot gas generator with a multi-fuel multiple lance burner with a central burner according to the invention.

With reference to FIG. 6, once again by way of an overview, the different feeds to a multi-fuel multiple lance burner system 400 with a central burner 1 according to the invention are explained below.

In the combustion chamber 60 of the burner 400 a perforated jacket unit 441 is schematically shown within a burner muffle 442. Together with the burner 400, a hot gas generator 401 is thus produced which supplies for example hot process gases for a grinding plant.

The inner pipe 11 of the central lance 10 in the same way as the outer lances 21 of the central burner 1 are connected to a feed for a first combustion gas such as natural gas. The feed to the outer lances 21 is hereby realised via a feed chamber 421. This feed chamber, in the same way as the feed chambers described below, is used to even out the inflow of the fluid and ensure a most regular inflow possible into the connected pipes or lances.

As shown in the illustration, both the inner pipe 11 and the outer lance 21 have the same gas supply source. Merely one branch is provided which distributes the gas in a predefined ratio to the inner pipe 11 and the outer lances 21. By means of a feed chamber 422, a second different combustion gas such as for example synthesis gas can be fed to the second fuel lances 410.

In order to supply in particular the central lance with combustion air a feed chamber 423 is used.

The remaining combustion air is fed via a feed chamber 424 to the burner 400. In addition a recirculation gas supply into the combustion chamber 424 is hereby provided. This serves to reduce the oxygen content of the combustion air in order that the heated process gas generated has an oxygen content which is as low as possible.

In addition, via the perforated jacket unit 441, further process gas to be heated can be fed to the hot gas generator 401. The total heated process gas is then fed for example to a grinding process with a roller mill.

It is possible with the central burner according to the invention to construct multi-fuel multiple lance burner systems without a starter burner, whereby said systems can each be differently constructed without hereby having to change the central burner.

The invention claimed is:

1. Multi-fuel multiple lance burner, which is formed without a start burner and comprising a central burner for multi-fuel multiple lance burner systems, having a central lance with an inner pipe and an outer pipe which are provided coaxially relative to each other, wherein the inner pipe and the outer pipe are arranged spaced apart from each other in the radial direction to form an annular clearance duct, and combustion media can be conveyable through the annular clearance duct, wherein the outer pipe of the central lance extends from a first feed chamber to a combustion chamber, wherein a plurality of outer lances are arranged around the central lance, said outer lances extending from at least a second feed chamber to the combustion chamber, wherein the outer pipe extends further into the combustion chamber than the inner pipe, wherein a funnel-like mixing device is provided in the extension of the annular clearance duct in the region of the end of the inner pipe, said mixing device having an opening in the region of the end of the inner pipe, said opening corresponding substantially to the diameter of the inner pipe, wherein the mixing device has in the extension of the annular clearance duct at its end an opening which is larger than the diameter of the inner pipe and smaller than the diameter of the outer pipe, wherein openings for combustion media to flow through are provided in the wall of the mixing device, wherein a nozzle is provided on each outer lance, said nozzle having at least lateral openings arranged distributed asymmetrically along the lateral circumferential area of the nozzle, wherein the outer lances and/or the nozzles of the outer lances are formed to be axially rotatable in order to influence the position of the openings of the nozzles, wherein an impeller is provided which is formed in the region between the inner wall of a central burner pipe or the inner wall of a burner outer pipe and the outer pipe of the central lance, and wherein the impeller is formed to be axially displaceable, and wherein the multi-fuel multiple lance burner is characterised in that the outer lances are arranged at an equal radial distance from the central lance, in particular in a ring-like manner.

2. Multi-fuel multiple lance burner according to claim 1, characterised in that swirl means are provided on the inner wall of the outer pipe and/or on the outer wall of the mixing device.

3. Multi-fuel multiple lance burner according to claim 1, characterised in that the inner pipe is terminated with a nozzle which has openings in the axial and/or radial direction.

4. Multi-fuel multiple lance burner according to claim 1, characterised in that the central burner is arranged within the central burner pipe.

5. Multi-fuel multiple lance burner according to claim 1, characterised in that swirl means are provided on the inner wall of the central burner pipe.

6. Multi-fuel multiple lance burner according to claim 1, characterised in that second fuel lances are arranged around the central burner pipe and the second fuel lances are formed from two pipes arranged one inside the other.

7. Multi-fuel multiple lance burner according to claim 1, characterised in that second fuel lances are provided arranged around the central burner at an equal radial distance from the central lance, in particular in a ring-like manner.

8. Multi-fuel multiple lance burner according to claim 1, characterised in that the second fuel lances are formed by a single pipe and have an end nozzle.

9. Multi-fuel multiple lance burner according to claim 1, characterised in that the burner outer pipe is provided surrounding the second fuel lances.

10. Multi-fuel multiple lance burner according to claim 9, characterised in that swirl means are provided on the inner wall of the burner outer pipe.

* * * * *